US008939381B2

(12) United States Patent
Choi et al.

(10) Patent No.: US 8,939,381 B2
(45) Date of Patent: Jan. 27, 2015

(54) FOG REMOVAL SYSTEM

(75) Inventors: Jun Seong Choi, Seoul (KR); Jong Seob Song, Incheon (KR); Jun Cheol Choi, Cheongju-si (KR); Sung Min Kang, Seoul (KR)

(73) Assignee: Korea Maintenance Co., Ltd., Seoul (KR)

( * ) Notice: Subject to any disclaimer, the term of this patent is extended or adjusted under 35 U.S.C. 154(b) by 0 days.

(21) Appl. No.: 13/981,322

(22) PCT Filed: Jan. 30, 2012

(86) PCT No.: PCT/KR2012/000677

§ 371 (c)(1),
(2), (4) Date: Jul. 24, 2013

(87) PCT Pub. No.: WO2012/105771

PCT Pub. Date: Aug. 9, 2012

(65) Prior Publication Data

US 2013/0299603 A1 Nov. 14, 2013

(30) Foreign Application Priority Data

Jan. 31, 2011 (KR) ..... 10-2011-0009338

(51) Int. Cl.

| | |
|---|---|
| ***A01G 15/00*** | (2006.01) |
| ***E01H 13/00*** | (2006.01) |
| ***A01G 27/00*** | (2006.01) |
| ***B05B 1/24*** | (2006.01) |

(52) U.S. Cl.

CPC ..... *E01H 13/00* (2013.01)

USPC ..... 239/14.1; 239/67; 239/128; 239/133; 239/134; 239/135

(58) Field of Classification Search

USPC ..... 239/14.1, 67, 69, 128, 133, 134, 135, 239/139

See application file for complete search history.

(56) References Cited

U.S. PATENT DOCUMENTS

| | | | | | |
|---|---|---|---|---|---|
| 3,196,822 | A | * | 7/1965 | Bertin et al. | 114/261 |
| 3,603,507 | A | * | 9/1971 | Devlin | 239/14.1 |
| 3,952,950 | A | * | 4/1976 | Pocrnja et al. | 239/14.1 |
| 4,125,223 | A | * | 11/1978 | Carver et al. | 239/14.1 |
| 4,836,086 | A | * | 6/1989 | Cecconi | 454/370 |
| 5,242,109 | A | * | 9/1993 | Esmond | 239/2.1 |

FOREIGN PATENT DOCUMENTS

| | | | |
|---|---|---|---|
| JP | 08-105026 | A | 4/1996 |
| JP | 2001-220724 | A | 8/2001 |
| JP | 2004-238803 | A | 8/2004 |
| KR | 10-0715360 | B1 | 5/2007 |

* cited by examiner

*Primary Examiner* — Ryan Reis
(74) *Attorney, Agent, or Firm* — Revolution IP, PLLC

(57) ABSTRACT

Disclosed is a fog removal system which can blow dry air onto roads, airport runways, harbors, or into coastal areas in which fog regularly occurs to reduce the relative humidity of atmospheric air down from about 100%, to thereby remove the fog. Particularly, in the fog removal system, a heating unit and a blowing unit may be connected to areas such as roads, airport runways, harbors, or coastal areas in which fog regularly occurs, to blow dry air generated in the heating unit over a long range using a strong blowing pressure from the blowing unit.

7 Claims, 2 Drawing Sheets

FOG REMOVAL SYSTEM

CROSS REFERENCE TO PRIOR APPLICATIONS

This application is a National Stage Application of PCT International Patent Application No. PCT/KR2012/000677 filed on Jan. 30, 2012, under 35 U.S.C. §371, which claims priority to Korean Patent Application No. 10-2011-0009338 filed on Jan. 31, 2011, which are all hereby incorporated by reference in their entirety.

TECHNICAL FIELD

The present invention relates to removal of fog by blowing dry air onto areas such as roads, airport runways, harbors, or coastal areas in which fog regularly occurs, to reduce a relative humidity of atmospheric air that has a relative humidity of 100%. More particularly, the present invention relates to a fog removal system in which a heating unit and a blowing unit are connected to areas such as roads, airport runways, harbors, or coastal areas in which fog regularly occurs, to transfer dry air generated by the heating unit to the blowing unit and blow the transferred dry air over a long range by using a strong blowing pressure of the blowing unit. This reduces the relative humidity of wet atmospheric air in the area where fog occurs by using the dry air. When applied to a road, the fog removal system may be installed in a longitudinal direction of the road, spaced a predetermined distance apart on both sides of inbound and outbound lanes of the road, to remove fog by using dry air and form an air curtain by using the dry air blown from both sides of the road to block advection fog introduced from the outside by using the air curtain. Thus, a visual range of drivers can be secured along the road.

BACKGROUND ART

In general, fog begins to form when water vapor in atmospheric air condenses into tiny water droplets at or near a cool water surface or ground surface. In order to form many tiny water droplets from water vapor in atmospheric air such as fog, the following conditions have to be met.

- There must be sufficient water vapor in the atmospheric air
- Air must cool to a temperature equal to or lower than a dew point
- Many condensation nuclei, which are tiny hydroscopic particles for accelerating condensation of water vapor into tiny water droplets in the atmospheric air, must be suspended in the atmospheric air
- A water vapor supply source must exist nearby.

When air cools under these conditions, fog occurs. In areas in which fog occurs, it is very important to secure good visibility of drivers, captains, or pilots when cars run on roads, ships enter or leave harbors, or airplanes enter or leave airport runways. Fog, a natural phenomenon resulting from a rapidly changing temperature, greatly reduces visibility, thereby substantially hindering safe operations.

That is, a pilot who operates an airplane may not secure a sufficient visual range in thick fog so that the airplane may not safely take off or land. In particular, when the airplane is to land and thick fog occurs over an airplane runway, since the pilot has to take the airplane to another airport, passengers may feel discomfort and an airline may suffer huge losses.

Also, there are areas in which fog regularly occurs along highways on which cars travel. Fog is one of the most dangerous factors in blocking visibility of drivers on roads. The frequency of accidents due to fog that hinders safe operations is actually high, and the risk of chain collisions may increase due to fog.

Accordingly, to solve these problems, methods of further improving forward visibility by mounting a fog lamp on the front of a car or blinking an emergency lamp have been used. However, since these methods greatly reduce driving speeds of cars and thereby obstruct smooth traffic flow and cause traffic jams, economic losses are incurred. Also, since these methods do not fundamentally remove fog, similar accidents repeatedly occur in areas in which fog regularly occurs, thereby leading to mass casualties.

Fog is classified into various types based on various factors such as causes or geographical features. There is fog that occurs in a certain region and is stagnant from the ground to a high altitude, and fog that occurs in a region and moves along the ground. In the case of the latter fog which moves along the ground, the fog may be prevented to some extent from entering onto a road and reducing visibility of drivers by installing physical barrier walls along both boundary sides of a road. In fact, however, the barrier walls may physically block fog but do not remove fog. As a result, since fog traveling along the ground rises and falls along the barrier walls and enters onto the road, it is difficult to expect that the barrier walls may block fog and thus prevent various accidents due to fog on the road, and costs of installing the barrier walls are high.

DISCLOSURE

Technical Problem

The present invention is directed to providing a fog removal system that can remove fog in areas such as roads, airport runways, harbors, or coastal areas in which fog regularly occurs, by heating air by using a heating unit to generate dry air, transferring the dry air to a blowing unit, and blowing the transferred dry air over a long range by using a strong blowing pressure of the blowing unit to reduce the relative humidity of wet atmospheric air by using the blown dry air. The fog removal system can also prevent safety-related accidents occurring due to fog by being installed in a longitudinal direction of a highway or a road, spaced a predetermined distance apart on both sides of opposite lanes in an area where fog regularly occurs, to blow dry air and form an air curtain by using the dry air generated from both sides of the road to block the movement of advection fog.

Also, the present invention is directed to providing a fog removal system that may actively remove fog by installing a light-emitting unit on a rear end portion of a blowing unit and installing an illuminance-detecting sensor unit on a front end portion of the blowing unit such that the light-emitting unit and the illuminance-detecting sensor unit are spaced apart by a predetermined distance from each other in an area where fog regularly occurs, to detect an illuminance of sunlight and an illuminance of the light-emitting unit of the blowing unit, analyze illuminance data to determine whether it is foggy, and when it is determined to be foggy, automatically drive a heating unit and the blowing unit to blow dry air.

Technical Solution

One aspect of the present invention provides a fog removal system installed with a predetermined spacing in an area where fog regularly occurs, blowing dry air to reduce the relative humidity of atmospheric air by using the dry air, and thereby removing fog, the fog removal system including: a heating unit that is installed in the areas in which fog regularly occurs and heats air by using a heating part to generate the dry air; a blowing unit that is connected to the heating unit, receives the dry air generated by the heating unit, and blows the dry air into a foggy area by using a strong blowing pressure over a long range; a connection unit that connects between the heating unit and the blowing unit to transfer the dry air generated by the heating unit to the blowing unit; a light-emitting unit that is formed on a rear end portion of the blowing unit and configured to emit light by using a high luminance light-emitting diode (LED); an illuminance-detecting sensor unit that is formed on a front end portion of the blowing unit and detects illuminances of sunlight and the light generated by the light-emitting unit of the blowing unit which is spaced apart by a predetermined distance from the illuminance-detecting sensor unit; a fog removal control unit that controls the illuminance-detecting sensor unit formed on the front end portion of the blowing unit to detect the illuminances of sunlight and the light generated by the light-emitting unit formed on the rear end portion of the blowing unit of the fog removal system which is spaced apart by the predetermined distance from the illuminance-detecting sensor unit, compare detected data with preset threshold values, analyze the compared data to determine whether it is foggy, and when it is determined to be foggy, automatically drive the heating unit and the blowing unit; and a driving control unit that controls the heating unit and the blowing unit to rotate vertically and horizontally and to automatically turn on/off under the control of the fog removal control unit.

Also, the heating unit may be installed in an area where fog occurs, heat air by using the heating unit to generate the dry air, and transfer the generated dry air to the blowing unit via the connection unit through a heat transfer blowing part. And, the heating unit may be a fuel-fired heating unit or an electrical heating unit.

The blowing unit may include a blowing housing that receives the dry air generated by the heating unit via the connection unit and blows the received dry air by using a strong blowing pressure, and a blowing driver that is formed on a rear end portion of the blowing housing and generates the strong blowing pressure through rotation of a propeller by a motor with respect to the dry air received from the heating unit.

Also, the illuminance-detecting sensor unit may include a first illuminance sensor that measures an illuminance of the light generated by the light-emitting unit of the blowing unit that is installed to be spaced apart by the predetermined distance from the illuminance-detecting sensor unit, and a second illuminance sensor that measures an illuminance of sunlight at a place in which the blowing unit is located.

The fog removal control unit may include: a data collector that receives illuminance data of the light-emitting unit and illuminance data of sunlight of the blowing unit that is spaced apart by the predetermined distance from the illuminance-detecting sensor unit, which are measured by the illuminance-detecting sensor unit; a first data comparator that compares measured data of the first illuminance sensor received through the data collector with a preset threshold value; a second data comparator that compares measured data of the second illuminance sensor received through the data collector with a preset threshold value; a data analyzer that compares and analyzes the data compared by the first data comparator and the data compared by the second data comparator to determine whether it is foggy; and a data transmitter that transmits a driving command according to a result of the determination of the data analyzer to the driving control unit.

Also, the driving control unit may include: an on/off controller that automatically turns the heating unit and the blowing unit on/off according to a command transmitted from a data transmitter of the fog removal control unit; a vertical driver that supports the heating unit and the blowing unit and vertically rotates the heating unit and the blowing unit through a predetermined angle; and a horizontal driver that horizontally rotates the heating unit and the blowing unit through a predetermined angle.

When applied to a road, the fog removal system may remove fog by being installed in a longitudinal direction of the road, spaced a predetermined distance apart on both sides of opposite lanes of the road, and forming an air curtain over the road by blowing dry air to block the movement of advection fog and reduce the relative humidity in the atmospheric air by using the dry air.

Advantageous Effects

The present invention can prevent accidents due to fog and minimize casualties by installing a fog removal system in areas such as roads, airport runways, harbors, or coastal areas in which fog regularly occurs, and blowing dry air over a long range by using a strong blowing pressure to reduce a relative humidity of 100% of wet air in an area where fog occurs by using the blown dry air to remove fog. When applied to a road, the present invention can block the movement of advection fog by installing the fog removal system in a longitudinal direction of the road, spaced a predetermined distance apart on both sides of an inbound lane and an outbound lane, to remove fog and form an air curtain by using dry air blown from both sides.

Also, the present invention can actively remove fog by installing an illuminance-detecting sensor unit on a blowing unit that is installed in an area where fog regularly occurs, to detect illuminances of sunlight and light emitted by a light-emitting unit that is spaced apart by a predetermined distance from the illuminance-detecting sensor unit, and analyzing illuminance data to determine whether it is foggy.

BEST MODE OF THE INVENTION

The present invention can remove fog by blowing dry air onto areas such as roads, airport runways, harbors, or coastal areas in which fog regularly occurs, to reduce a relative humidity of 100% of wet atmospheric air. When applied to a road, the fog removal system may be installed in a longitudinal direction of the road, spaced a predetermined distance apart on both sides of inbound and outbound lanes of the road, to remove fog by using dry air and form an air curtain by using the dry air blown from both sides of the road to block advection fog introduced from the outside by using the air curtain. Thus, a visual range of drivers can be secured along the road. The present invention will be explained in detail with reference to the attached drawings.

MODES OF THE INVENTION

Figure 1:
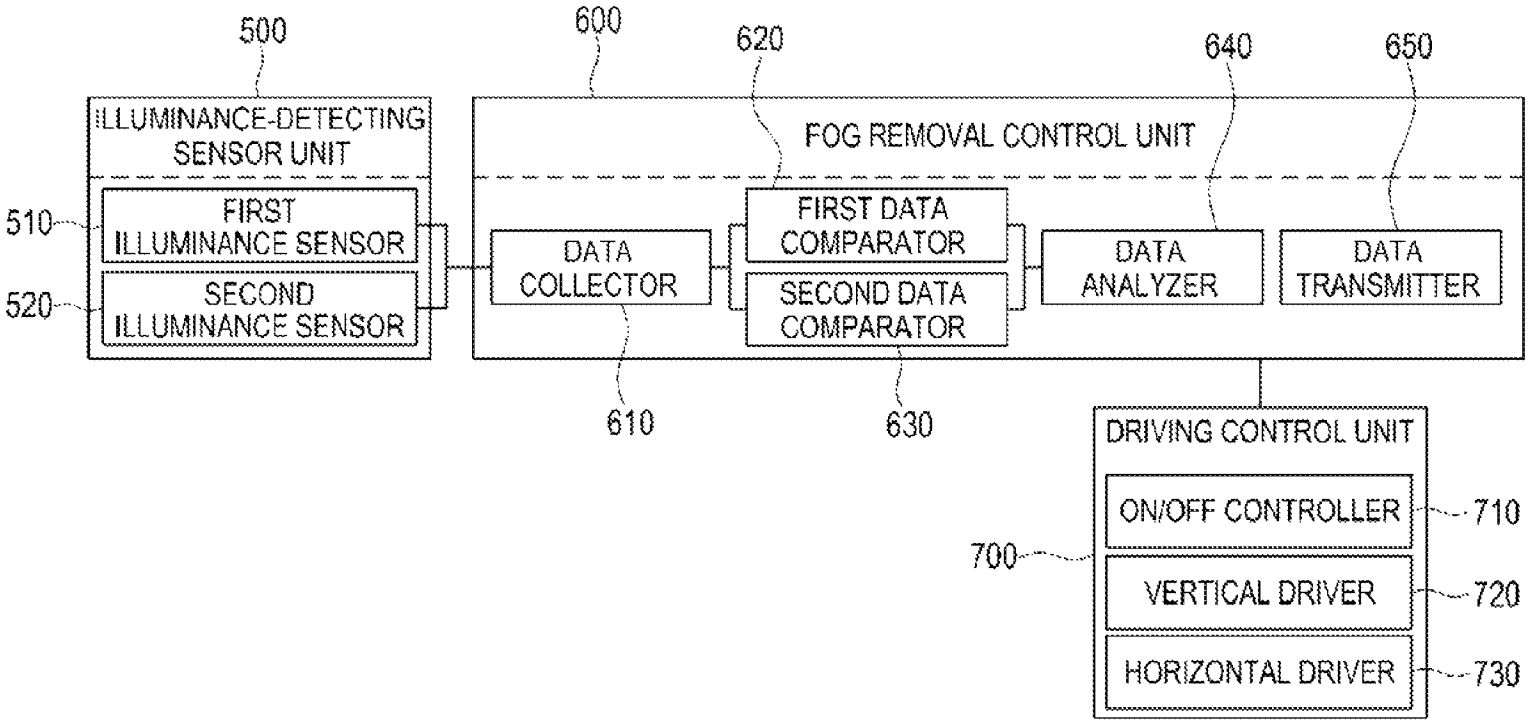
FIG. 1 is a block diagram illustrating a structure of a fog removal system according to the present invention.
Figure 2:
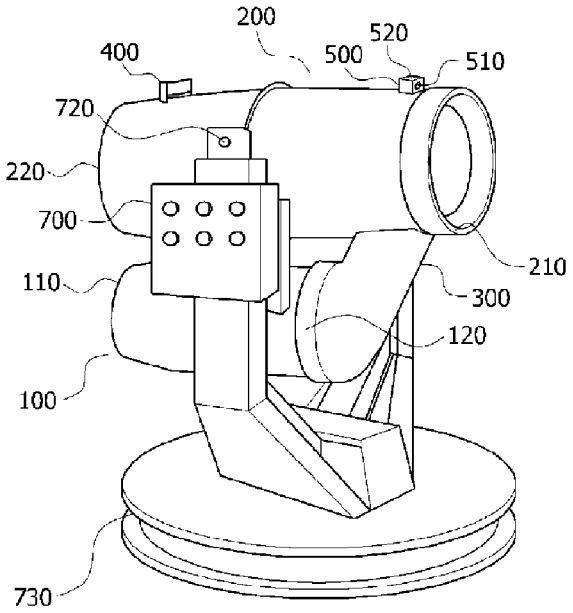
FIG. 2 is a front perspective view illustrating the fog removal system according to the present invention.
Figure 3:
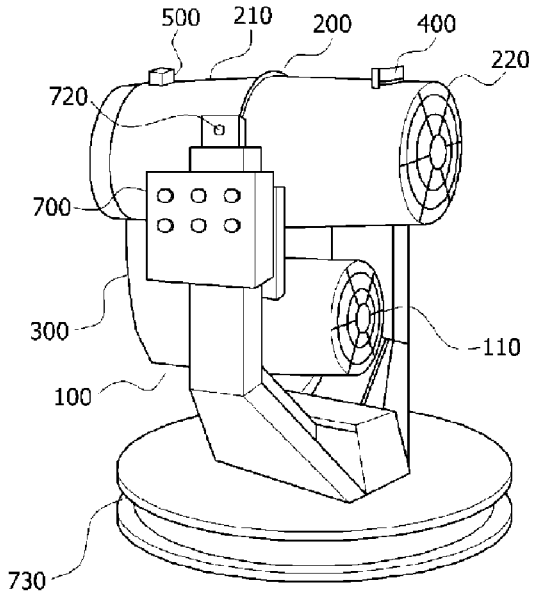
FIG. 3 is a rear perspective view illustrating the fog removal system according to the present invention.

FIG. 1 is a block diagram illustrating a structure of a fog removal system according to the present invention. FIG. 2 is a front perspective view illustrating the fog removal system according to the present invention. FIG. 3 is a rear perspective view illustrating the fog removal system according to the present invention.

As shown in FIGS. 1 through 3, the fog removal system for removing fog by blowing dry air onto areas such as roads, airport runways, harbors, or coastal areas in which fog regularly occurs, and by being installed in a longitudinal direction of a road, spaced a predetermined distance apart, in an area where fog regularly occurs, to blow dry air and reduce a relative humidity of 100% of wet atmospheric air, includes a heating unit 100 that is installed in areas in which fog regularly occurs and heats air by using a heating part 110 to generate dry air, a blowing unit 200 that is connected to the heating unit 100, receives the dry air generated by the heating unit 100, and blows strongly by using a strong blowing pressure to blow the dry air over a long range into a foggy area, a connection unit 300 that connects the heating unit 100 and the blowing unit 200 to transfer the dry air generated by the heating unit 100 to the blowing unit 200, a light-emitting unit 400 that is formed on a rear end portion of the blowing unit 200 and configured to emit light by using a high-brightness light-emitting diode (LED), an illuminance-detecting sensor unit 500 that is formed on a front end portion of the blowing unit 200 and detects illuminances of sunlight and the light generated by the light-emitting unit 400 of the blowing unit 200, which is spaced apart by a predetermined distance from the illuminance-detecting sensor unit 500, a fog removal control unit 600 that controls the illuminance-detecting sensor unit 500 formed on the front end portion of the blowing unit 200 to detect the illuminances of sunlight and the light generated by the light-emitting unit 400 that is formed on the rear end portion of the blowing unit 200 of the fog removal system to be spaced apart by the predetermined distance from the illuminance-detecting sensor unit 500, compare detected data with preset threshold values, analyze the compared data to determine whether it is foggy, and when it is determined to be foggy, automatically drive the heating unit 100 and the blowing unit 200, and a driving control unit 700 that controls the heating unit 100 and the blowing unit 200 to rotate vertically and horizontally and to automatically turn on/off under the control of the fog removal control unit 600.

The heating unit 100 is installed in an area where fog occurs, heats air by using the heating part 110 to generate dry air, blows the generated dry air through a heat transfer blowing part 120, transfers the dry air to the blowing unit 200 via the connection unit 300, and blows the dry air transferred to the blowing unit 200 over a long range by using a strong airflow due to a strong blowing pressure of the blowing unit 200, to reduce a humidity in wet atmospheric air, thereby removing fog. The heating unit 100 is divided into a fuel-fired type and an electrical type, and may be selectively used according to needs.

The blowing unit 200 receiving the dry air via the connection unit 300 from the heating unit 100 includes a blowing housing 210 that blows the received dry air by using a strong blowing pressure and a blowing driver 220 that is formed on a rear end portion of the blowing housing 210 and generates the strong blowing pressure through rotation of a propeller by a motor to blow the dry air received from the heating unit 100 over a long range, and removes fog by blowing the dry air over a long range to reduce a relative humidity of atmospheric air.

Also, the illuminance-detecting sensor unit 500 includes a first illuminance sensor 510 that measures an illuminance of light generated by the light-emitting unit 400 of the blowing unit 200 which is spaced apart by a predetermined distance from the illuminance-detecting sensor unit 500, and a second illuminance sensor 520 that measures an illuminance of sunlight of a place where the blowing unit 200 is located, and measures the illuminances of sunlight and the light generated by the light-emitting unit 400 that is spaced apart by a predetermined distance from the illuminance-detecting sensor unit 500, distinguishes between daytime and nighttime, and measures whether it is foggy by using the illuminance of the light generated by the light-emitting unit 400 at nighttime.

The fog removal control unit 600 includes a data collector 610 that receives illuminance data about the sunlight and illuminance data of the light-emitting unit 400 of the blowing unit 200 which is spaced apart by a predetermined distance from the illuminance-detecting sensor unit 500, a first data comparator 620 that compares measured data of the first illuminance sensor 510 received from the data collector 610 with a preset threshold value, a second data comparator 630 that compares measured data of the second illuminance sensor 520 received from the data collector 610 with a preset threshold value, a data analyzer 640 that compares and analyzes the data compared by the first data comparator 620 and the data compared by the second data comparator 630 and distinguishes between daytime and nighttime to determine whether it is foggy, and a data transmitter 650 that transmits a driving command according a result of the determination of the data analyzer 640 to the driving control unit 700.

The driving control unit 700 includes an on/off controller 710 that automatically turns the heating unit 100 and the blowing unit 200 on/off according to the command transmitted from the data transmitter 650 of the fog removal control unit 600, a vertical driver 720 that supports the heating unit 100 and the blowing unit 200 and vertically rotates the heating unit 100 and the blowing unit 200 through a predetermined angle, and a horizontal driver 730 that horizontally rotates the heating unit 100 and the blowing unit 200 through a predetermined angle.

Also, when applied to a road, the present invention may be installed in a longitudinal direction of the road, spaced a predetermined distance apart on both sides of an inbound lane and an outbound lane, to form an air curtain over the road onto which dry air is blown over a long range, to block the movement of advection fog and reduce the relative humidity of atmospheric air by using the dry air, thereby removing fog.

The present invention configured as described above for removing air by being installed at a predetermined spacing in an area where fog regularly occurs and blowing dry air over a long range to reduce the relative humidity of atmospheric air by using dry air is, when applied to a road, installed in a longitudinal direction of the road, spaced a predetermined distance apart on both sides of an inbound lane and an outbound lane of the road in an area where fog regularly occurs. When the light-emitting unit 300 installed on a rear end surface of the blowing unit 200 that is located a predetermined distance in front of the light-emitting unit emits light, the first illuminance sensor 510 installed on the front end portion of the blowing unit 200 that is located the predetermined distance behind the first illuminance sensor 510 measures an illuminance of the light emitted by the light-emitting unit 400 and the second illuminance sensor 520 measures an illuminance of sunlight. Illuminance data measured by the first illuminance sensor 510 and the second illuminance sensor 520 is transferred to the data collector 610 of the fog removal control unit 600 and compared with preset threshold values set by the first data comparator 620 and the second data comparator 630, and the data analyzer 640 determines whether it is foggy by using the compared data. When the data analyzer 640 determines that it is foggy, the data transmitter 650 transmits a driving command to the driving control unit 700 to drive the heating unit 100 and the blowing unit 200, and the driving control unit 700 drives the heating unit 100 and the blowing unit 200 by using the received command to reduce a relative humidity of atmospheric air in the area in which it is foggy by using blown dry air, thereby removing fog. In this case, the dry air generated by the heating unit 100 is transferred to the blowing unit 200 via the connection unit 300, and is blown over a long range by using a strong airflow due to a strong blowing pressure generated by the blowing unit 200.

Also, when applied to a road, the present invention may be installed in a longitudinal direction of the road, spaced apart by a predetermined distance on both sides of an inbound lane and an outbound lane, and can form an air curtain over the road onto which dry air is blown to block the movement of advection fog, thereby removing fog and blocking the movement of the fog.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A fog removal system installed with a predetermined spacing in an area where fog regularly occurs, blowing dry air to reduce the relative humidity of atmospheric air by using the dry air, and thereby removing fog, the fog removal system comprising:

a heating unit that is installed in the areas in which fog regularly occurs and heats air by using a heating part to generate the dry air;

a blowing unit that is connected to the heating unit, receives the dry air generated by the heating unit, and blows the dry air into a foggy area by using a strong blowing pressure over a long range;

a connection unit that connects between the heating unit and the blowing unit to transfer the dry air generated by the heating unit to the blowing unit;

a light-emitting unit that is formed on a rear end portion of the blowing unit and configured to emit light by using a high luminance light-emitting diode (LED);

an illuminance-detecting sensor unit that is formed on a front end portion of the blowing unit and detects illuminances of sunlight and the light generated by the light-emitting unit of the blowing unit which is spaced apart by a predetermined distance from the illuminance-detecting sensor unit;

a fog removal control unit that controls the illuminance-detecting sensor unit formed on the front end portion of the blowing unit to detect the illuminances of sunlight and the light generated by the light-emitting unit formed on the rear end portion of the blowing unit of the fog removal system which is spaced apart by the predetermined distance from the illuminance-detecting sensor unit, compare detected data with preset threshold values, analyze the compared data to determine whether it is foggy, and when it is determined to be foggy, automatically drive the heating unit and the blowing unit; and a driving control unit that controls the heating unit and the blowing unit to rotate vertically and horizontally and to automatically turn on/off under the control of the fog removal control unit.

2. The fog removal system of claim 1, wherein the heating unit is installed in an area where fog occurs, heats air by using the heating unit to generate the dry air, and transfers the generated dry air to the blowing unit via the connection unit through a heat transfer blowing part, and the heating unit is a fuel-fired heating unit or an electrical heating unit.

3. The fog removal system of claim 1, wherein the blowing unit comprises a blowing housing that receives the dry air generated by the heating unit via the connection unit and blows the received dry air by using a strong blowing pressure, and a blowing driver that is formed on a rear end portion of the blowing housing and generates the strong blowing pressure through rotation of a propeller by a motor with respect to the dry air received from the heating unit.

4. The fog removal system of claim 1, wherein the illuminance-detecting sensor unit comprises a first illuminance sensor that measures an illuminance of the light generated by the light-emitting unit of the blowing unit that is installed to be spaced apart by the predetermined distance from the illuminance-detecting sensor unit, and a second illuminance sensor that measures an illuminance of sunlight at a place in which the blowing unit is located.

5. The fog removal system of claim 1, wherein the fog removal control unit comprises:

a data collector that receives illuminance data of the light-emitting unit and illuminance data of sunlight of the blowing unit that is spaced apart by the predetermined distance from the illuminance-detecting sensor unit, which are measured by the illuminance-detecting sensor unit;

a first data comparator that compares measured data of the first illuminance sensor received through the data collector with a preset threshold value;

a second data comparator that compares measured data of the second illuminance sensor received through the data collector with a preset threshold value;

a data analyzer that compares and analyzes the data compared by the first data comparator and the data compared by the second data comparator to determine whether it is foggy; and a data transmitter that transmits a driving command according to a result of the determination of the data analyzer to the driving control unit.

6. The fog removal system of claim 1, wherein the driving control unit comprises:

an on/off controller that automatically turns the heating unit and the blowing unit on/off according to a command transmitted from a data transmitter of the fog removal control unit;

a vertical driver that supports the heating unit and the blowing unit and vertically rotates the heating unit and the blowing unit through a predetermined angle; and a horizontal driver that horizontally rotates the heating unit and the blowing unit through a predetermined angle.

7. The fog removal system of claim 1, wherein when applied to a road, the fog removal system removes fog by being installed in a longitudinal direction of the road, spaced a predetermined distance apart on both sides of opposite lanes of the road, and forming an air curtain over the road by blowing the dry air to block the movement of advection fog and reduce the relative humidity in the atmospheric air by using the dry air.

* * * * *